US007012356B2

(12) United States Patent
Park et al.

(10) Patent No.: US 7,012,356 B2
(45) Date of Patent: Mar. 14, 2006

(54) COLOR CATHODE RAY TUBE

(75) Inventors: Jin Tae Park, Gumi-si (KR); Je Yun Bae, Chilgok-goon (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 105 days.

(21) Appl. No.: 10/386,515

(22) Filed: Mar. 13, 2003

(65) Prior Publication Data

US 2004/0007957 A1 Jan. 15, 2004

(30) Foreign Application Priority Data

Jul. 15, 2002 (KR) ..... 2002-0041381
Jul. 23, 2002 (KR) ..... 2002-0043101

(51) Int. Cl.
*H01J 29/80* (2006.01)

(52) U.S. Cl. ..... 313/402; 313/403; 313/408

(58) Field of Classification Search ..... 313/402, 313/403, 408

See application file for complete search history.

(56) References Cited

U.S. PATENT DOCUMENTS 4,636,683 A * 1/1987 Tokita et al. ..... 313/403
5,534,746 A * 7/1996 Marks et al. ..... 313/408
5,689,149 A * 11/1997 Welles et al. ..... 313/402
5,771,039 A * 6/1998 Ditzik ..... 345/178
6,057,640 A * 5/2000 Aibara ..... 313/403
6,066,914 A 5/2000 Shimizu et al.
6,072,270 A * 6/2000 Hu et al. ..... 313/402
6,229,255 B1 5/2001 Kim et al.
6,333,594 B1 * 12/2001 Nakagawa et al. ..... 313/461
6,337,535 B1 1/2002 Kim
6,388,373 B1 5/2002 Nah
6,407,489 B1 * 6/2002 Lee ..... 313/402
6,486,596 B1 * 11/2002 Inoue et al. ..... 313/402
6,570,310 B1 * 5/2003 Aibara ..... 313/403
6,639,345 B1 * 10/2003 Inoue et al. ..... 313/461
6,642,644 B1 * 11/2003 Kim et al. ..... 313/402

FOREIGN PATENT DOCUMENTS

JP 09082234 A * 3/1997
JP 11191379 A * 7/1999

* cited by examiner

*Primary Examiner*—Vip Patel
(74) *Attorney, Agent, or Firm*—Birch, Stewart, Kolasch & Birch, LLP

(57) ABSTRACT

The present invention provides A color cathode ray tube comprising: a panel having a flat outer surface and an inner surface that has a predetermined curvature; and a shadow mask, wherein $$\frac{B2}{P2} \leq \frac{B3}{P3}$$

where B1 is a length of a bridge as a distance between holes in a vertical direction at a center portion of the shadow mask; B2 is a length of a bridge as a distance between holes in a vertical direction at four corner portions of the shadow mask; B3 is a length of a bridge as a distance between holes at edge portions of the shadow mask in a direction of a long axis thereof; P1 is a vertical pitch of the holes at the center portion of the shadow mask; P2 is a vertical pitch of the holes at the four corner portions of the shadow mask; and P3 is a vertical pitch of the holes at the edge portions of the shadow mask in a direction of a long axis thereof.

22 Claims, 5 Drawing Sheets

COLOR CATHODE RAY TUBE

BACKGROUND OF THE INVENTION

1. Field of the Invention

The present invention relates to a color cathode ray tube, and more particularly, to a shadow mask for a color cathode ray tube using Aluminum Killed (AK) which has improved brightness and bright uniformity at corners, reduced doming effect, enhanced curved surface maintenance strength and lowered production cost.

2. Background of the Prior Art

In general, the cathode ray tube is the display apparatus that converts electrical signals into electron beams and scans the fluorescent screen with the electron beams to generate visible light and thus display images. Such cathode ray tubes are the most popular display apparatus since they are very excellent in the ratio of display quality to cost.

FIG. 1 shows schematically a structure of a conventional color cathode ray tube. Referring to FIG. 1, the conventional cathode ray tube includes a panel 1 having its outer surface that is flat or has some curvature, and a funnel 2 coupled sealingly with the panel 1 to form a tube. The panel 1 and the funnel 2 are coupled sealingly with a frit glass. Since the tube including the panel 1 and the funnel 2 keeps its inside in a vacuum, it may explode due to an external impact, which is very dangerous. In order to prevent this, a strengthening band 12 is added to a contact portion of the panel 1 and the funnel 2.

The funnel 2 consists of a neck 10 whose shape is narrow tube and a cone portion that expands at the end of the neck 10. The neck 10 is provided with electron guns to project electron beams 11. The cone portion is provided with a deflection yoke 9 to deflect the electron beams 11. On the other hand, the colors of the electron beams deflected by the deflection yoke 9 are selected by a shadow mask 5 that has fine holes. The electron beams are shot across a fluorescent material coated on the inside of the panel 1, so that the fluorescent material emits lights of each color, red, green and blue. To achieve this, the shadow mask 5 has a lot of holes and each of the fluorescent materials for red, green and blue is coated on the fluorescent surface corresponding to the holes. The electron beams are shot across the fluorescent material to emit light and images are displayed on the fluorescent surface. The shadow mask 5 is supported by a frame 4 to be spaced with the panel 1. The support spring installed by the frame 4 is coupled with a stud pin 6 mounted on the panel 1 to be supported firmly in the tube. To prevent the electron beams 11 from shifting due to an external magnetic field, an inner shield 7 made of magnetic material is coupled with the frame 4 to be supported.

The operation of the general color cathode ray tube will be described. The electron guns 8 generate electron beams 11 and the electron beans 11 are shot across the fluorescent surface inside the panel 1 by a voltage applied to the cathode ray tube. In this time, the electron beams 11 are deflected by the deflection yoke 9. Each color of the beams is selected by the shadow mask 5. The electron beams 11 are properly shot across the fluorescent surfaces of red, green and blue so that the fluorescent surfaces emit lights to display a predetermined image.

FIG. 2 is a front view of the conventional shadow mask. Referring to FIG. 2, conventional shadow mask 5 is a thin metal plate that has a lot of holes 51. More specifically, the holes 51 are aligned vertically on the thin metal plate and rows of the holes 51 aligned vertically are aligned horizontally. The electron beams pass through the holes 51. Invar mask or AK (Aluminum Killed) is used as the material of the shadow mask 5. The invar mask is trice as expensive as the AK. Both of them are critically different from each other in physical characteristics and are shown in Table 1.

TABLE 1

| Material | INVAR | AK |
|---|---|---|
| Price | High | Low |
| Doming | Good | Bad |
| Etching | Bad | Good |
| Formability | Bad | Good |
| Main component (%) | Fe: 64–60<br>Ni: 35–36 | Fe: 99.7–99.0 |
| Thermal expansive coefficient | Equal to or less than $1.5 \times 10^{-6}/°$ C. | $8 - 20 \times 10^{-6}/°$ C. |

Referring to Table 1, AK is a pure iron that contains iron of 99.0%–99.7% and is inexpensive. However, its thermal expansive coefficient is $8–20\times10^{-6}/°$ C. and it is easier to be deformed than Invar. AK is as 5.3–13.3 times as Invar in their thermal expansive coefficients.

On the other hand, the doming means that the shadow mask 5 bulges due to heat. The heat is almost generated by the electron beams 11 striking the shadow mask 5 while the electron beams pass though the shadow mask 5. The degree of the doming determines the transmittance and the transmittance determines display quality.

The structure of the conventional shadow mask 5 will be described with reference to FIG. 2. The size and the shape of the conventional holes through which the electron beams pass are described. The structure of the conventional shadow mask satisfies the following relation:

$$\frac{B3}{P3} \leq \frac{B2}{P2}$$

where B1 is a length of a bridge as a distance between holes 51 in a vertical direction at the center portion of the shadow mask 5, B2 is a length of a bridge as a distance between holes 51 in a vertical direction at four corner portions of the shadow mask 5, B3 is a length of a bridge as a distance between holes 51 at edge portions of the shadow mask in a direction of a long axis of the shadow mask 5, P1 is a vertical pitch of the holes at the center portion of the shadow mask 5, P2 is a vertical pitch of the holes at the four corner portions of the shadow mask 5, and P3 is a vertical pitch of the holes at the edge portions of the shadow mask 5 in a direction of a long axis of the shadow mask 5.

Considering that a pitch Ph is the same as a horizontal width S, the mask transmittance of the four corner portions is reduced. This lowers brightness and uniformity (the ratio of the peripheral portions to the brightness of the center portion). In such a structure, the doming is more serious at the area around the holes of the edge portions in the direction of the long axis than at the corner portions. The reason is as follows. It is known that doming is less as the thermal capacity per unit area is larger. However, the conventional shadow mask that is designed to satisfy the condition $$\frac{B3}{P3} \leq \frac{B2}{P2}$$

has the bridge B2 at the diagonal corner portions to be greater than the bridge at the edge portion in the direction of the long axis. In this structure, since the thermal capacity at the corner portions in the direction of the long axis is forced to be comparatively less, the doming due to the electron beams is greater at diagonal corner portions. Because of the problems described above, in order to reduce doming, the Invar mask has been used in the conventional shadow mask 5 even though the Invar mask is expensive but the defect in the structure is still raised as a problem. Accordingly, it is required to suggest the shadow mask that overcomes the structural defect of the conventional shadow mask, is less expensive and has improved doming characteristics.

On the other hand, the outer surface of the effective portion is tended to be flat in order to improve affirmation. This requires for making the effective surface of the shadow mask 5 corresponding to the fluorescent screen installed on the inner surface of the effective portion flat. However, if the curvature radius of the shadow mask 5 is simply increased to make it flat, doming is caused since the shadow mask 5 is locally expanded by heat very greatly due to the collision of electron beams 11 of the high density. The doming makes the color purity degenerated.

To overcome this problem, the curvature radius in a direction of a long axis of the shadow mask is reduced to increase the curved sustain strength and suppress the doming. However, the curvature radius of the shadow mask cannot be small limitlessly since the curvature of the shadow mask relates to the curvature of the inner surface of the panel. If the curvature radius of the shadow mask is reduced, the curvature radius of the panel is also reduced. If the peripheral portions are thicker than the center portion by the amount more than some threshold, transmittance of the peripheral portions is reduced to lower the brightness of the peripheral portions and affirmation.

In this context, the proper curvature radius of the shadow mask should be suggested.

On the other hand, the curved surface strength of the shadow mask 5 is weakened due to the flatness of the shadow mask even though the shadow mask made of INVAR material is used in order to suppress the doming. Color cathode ray tube is easily damaged by an external impact. It is not wondering that the cathode ray tube including the shadow mask made of expensive INVAR material is very expensive.

Accordingly, the present invention is directed to a shadow mask for a color cathode tube that substantially obviate one or more problems due to limitations and disadvantages of the related art.

The present invention is suggested to overcome the above-mentioned problems. An object of the present invention is to provide a shadow mask for a color cathode ray tube to make the brightness of the corner portions proper, improve the bright uniformity of the entire screen and reduce doming at the edge portions in the direction of a long axis by improving the structure of shadow mask.

Another object of the present invention is to provide a shadow mask for a color cathode ray tube capable of reducing superior doming characteristic even though AK material is used for the shadow mask.

A further object of the present invention is to provide a shadow mask for a cathode ray tube to reduce doming effect, enhance the maintenance strength of the curved surface and provide the curvature radius of the shadow mask so that the ratio of the thickness of the peripheral portion to the thickness of the center portion is proper.

SUMMARY OF THE INVENTION

To achieve these objects and other advantages and in accordance with the purpose of the invention, as embodied and broadly described herein, there is provided a color cathode ray tube comprising: a panel having a fluorescent surface therein; a funnel coupled sealingly with the panel; electron guns installed in the funnel, for projecting electron beams; a deflection yoke for deflecting the electron beams; and a shadow mask for selecting colors, wherein the shadow mask has a following relation:

$$\frac{B2}{P2} \leq \frac{B3}{P3},$$

where B1 is a length of a bridge as a distance between holes in a vertical direction at center portion of the shadow mask; B2 is a length of a bridge as a distance between holes in a vertical direction at four corner portions of the shadow mask; B3 is a length of a bridge as a distance between holes at edge portions of the shadow mask in a direction of a long axis thereof; 'P1 is a vertical pitch of the holes at the center portion of the shadow mask; P2 is a vertical pitch of the holes at the four corner portions of the shadow mask; and P3 is a vertical pitch of the holes at the edge portions of the shadow mask in a direction of a long axis thereof.

In an aspect of the present invention, there is provided a color cathode ray tube comprising: a panel having a fluorescent surface therein; a funnel coupled sealingly with the panel; electron guns installed in the funnel, for projecting electron beams; a deflection yoke for deflecting the electron beams; and a shadow mask for selecting colors, wherein the shadow mask has a following relation:

$$5.5 < \frac{Rh}{\left(\frac{H}{2}\right)} < 8.0,$$

where Rh is the mean curvature radius in the direction of the long axis of the shadow mask, H is a distance between both ends in a direction of a long axis of an effective surface of the shadow mask, Zh is a recess amount in a direction of a tube axis at an end of the long axis of the effective surface with respect to a center of the effective surface, and a mean curvature radius in the direction of the long axis satisfies the following condition:

$$Rh = \left(\frac{H}{2}\right)^2 + \frac{Zh^2}{2 * Zh}.$$

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE PREFERRED EMBODIMENTS

Reference will now be made in detail to a preferred embodiment of the present invention with reference to the attached drawings.

Figure 1:
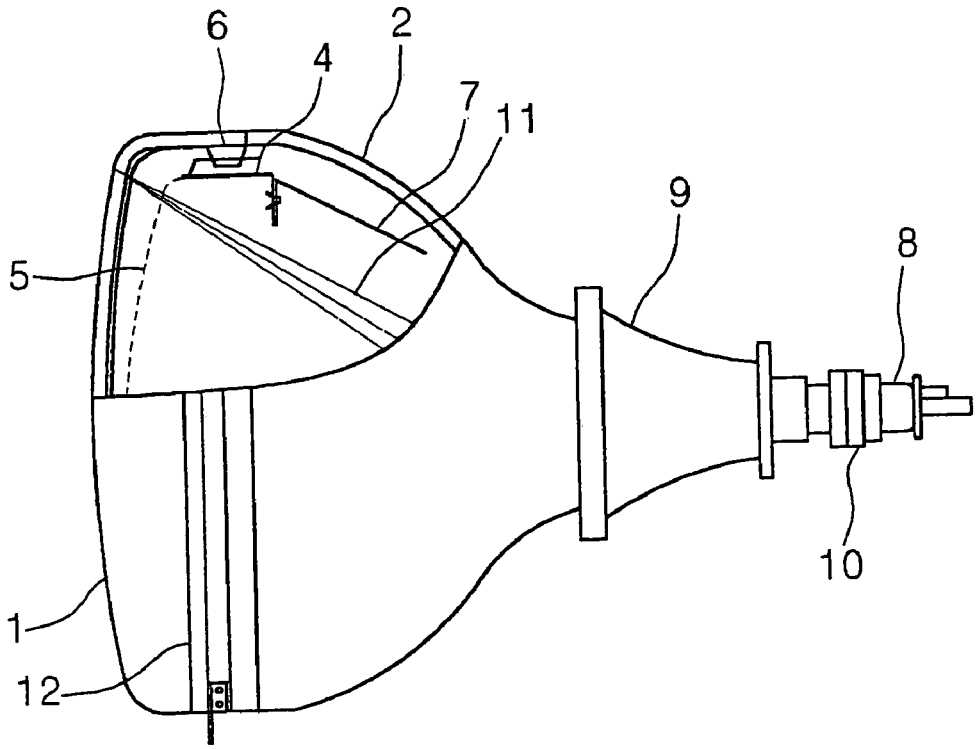
FIG. 1 (Related Art)
FIG. 1 shows schematically a structure of conventional color cathode ray tube.
Figure 2:
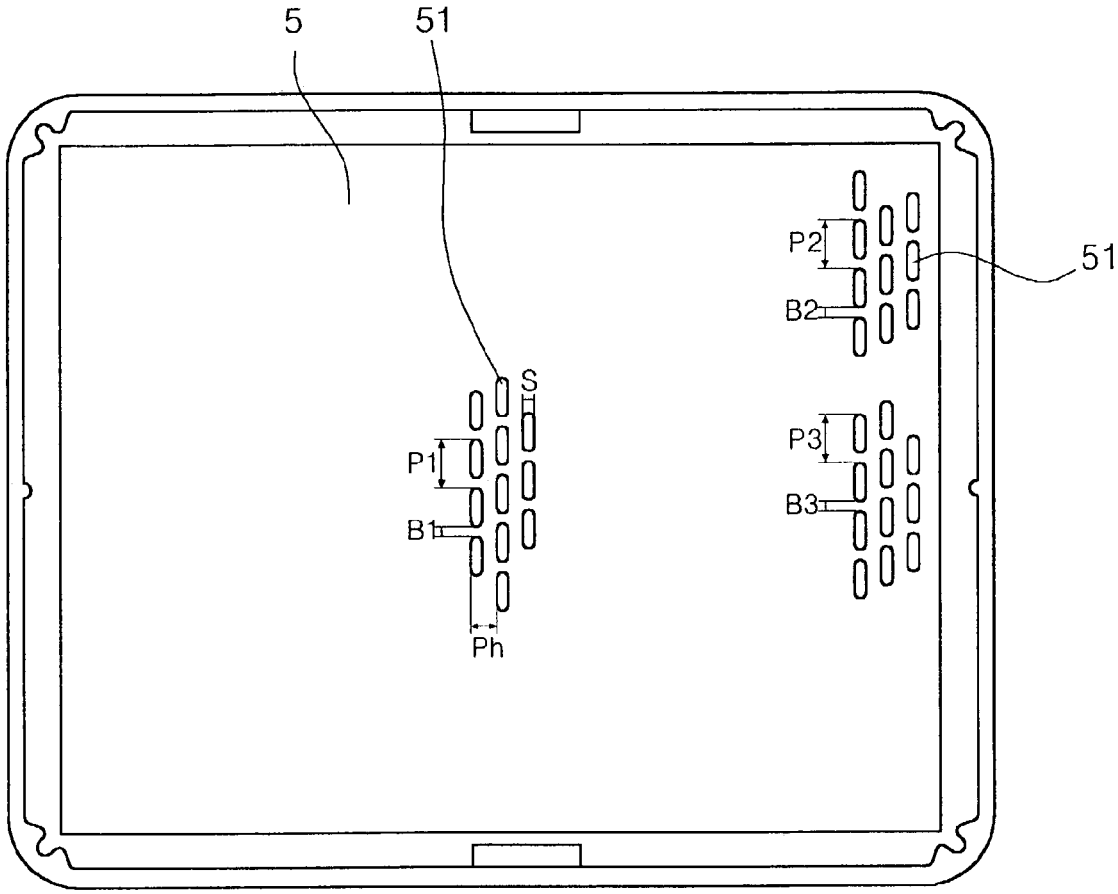
FIG. 2 (Related Art)
FIG. 2 is a front view of the conventional shadow mask.
Figure 3:
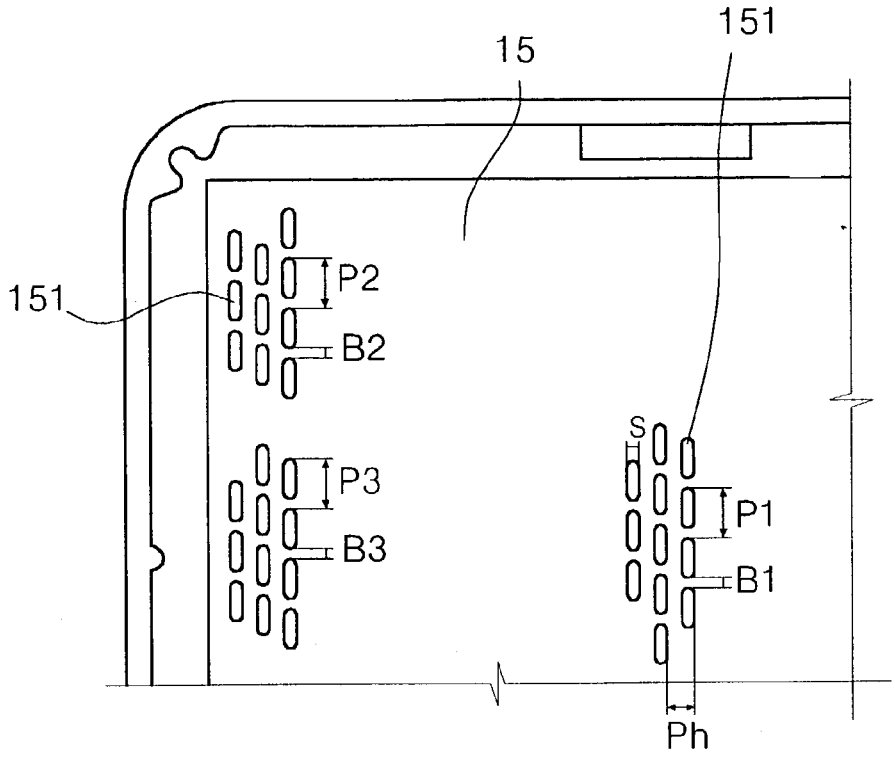
FIG. 3 is a front view of a shadow mask according to an embodiment of the present invention.

FIG. 3 is a front view of a shadow mask according to an embodiment of the present invention. Referring to the FIG. 3, the front surface of a shadow mask 15 is provided with a plurality of slotted holes 151. Etching using chemicals may be used in forming the holes 151. The plurality of holes 151 are aligned in horizontal and vertical directions spaced with one another with a predetermined distance. The vertically neighboring holes 151 are connected to each other via the bridge B. The holes 151 are the openings that electron beams pass through and extend vertically.

In the structure of the shadow mask 15 according to the present invention shown in FIG. 3, the size and the shape of the holes through which electron beams pass satisfy the following relation:

$$\frac{B2}{P2} \leq \frac{B3}{P3}$$

where B1 is a length of a bridge as a distance between holes 151 in a vertical direction at a center portion of the shadow mask 15, B2 is a length of a bridge as a distance between holes 151 in a vertical direction at four corner portions of the shadow mask 15, B3 is a length of a bridge as a distance between holes 151 at edge portions of the shadow mask in a direction of a long axis of the shadow mask 15, P1 is a vertical pitch of the holes 151 at the center portion of the shadow mask 15, P2 is a vertical pitch of the holes 151 at the four corner portions of the shadow mask 15, and P3 is a vertical pitch of the holes 151 at the edge portions of the shadow mask in a direction of a long axis of the shadow mask 15.

The structure of the shadow mask 15 according to the present invention satisfying the above relation improves brightness and bright uniformity by enhancing the transmittance at corners comparatively more than that at edge portions in the direction of the long axis. The high transmittance implies low thermal capacity per unit area. In other words, it is designed such that the thermal capacity of the edge portions is relatively larger than that of diagonal corner portions, which is advantageous at doming.

Preferably, the shadow mask 15 of the present invention satisfies a relation of $$\frac{B1}{P1} \leq \frac{B2}{P2} \leq \frac{B3}{P3},$$

where B1 is a length of a bridge as a distance between holes 151 in a vertical direction at a center portion of the shadow mask 15, B2 is a length of a bridge as a distance between holes 151 in a vertical direction at four corner portions of the shadow mask 15, B3 is a length of a bridge as a distance between holes 151 at edge portions of the shadow mask in a direction of a long axis of the shadow mask 15, P1 is a vertical pitch of the holes 151 at the center portion of the shadow mask 15, P2 is a vertical pitch of the holes 151 at the four corner portions of the shadow mask 15, and P3 is a vertical pitch of the holes 151 at the edge portions of the shadow mask in a direction of a long axis of the shadow mask 15. If $$\frac{B1}{P1} > \frac{B2}{P2} \text{ or } \frac{B2}{P2} > \frac{B3}{P3},$$

then the transmittance of the center portion is lowered and thus it is difficult to realize the absolute brightness at the center portion.

Preferably, the shadow mask 15 of the present invention satisfies a relation of $B1 \leqq B2 \leqq B3$. If $B1>B2$ or $B1>B3$, the transmittance of the center portion is reduced. So it is difficult to realize the absolute brightness at the center portion and the doming at peripheral portions gets worse.

Preferably, the shadow mask 15 of the present invention satisfies a relation of $P3 \leqq P2 \leqq P1$. If $P1<P2$, $P1<P3$ or $P2<P3$, $B1 \leqq B2 \leqq B3$ should be very great to satisfy $$\frac{B1}{P1} \leq \frac{B2}{P2} \leq \frac{B3}{P3}.$$

In this case, the transmittance of the entire shadow mask is reduced, so that it is difficult to make a proper brightness.

Preferably, the shadow mask 15 of the present invention satisfies the relations of $0.10\text{ mm} \leqq B1 < 0.18\text{ mm}$, $0.10\text{ mm} \leqq B2 \leqq 0.18\text{ mm}$, and $0.10\text{ mm} \leqq B3 \leqq 0.18\text{ mm}$. If relationships are $B1<0.10$ mm, $B2<0.10$ mm and $B3<0.10$ mm, then the formability of the shadow mask degenerates since holes explode during the forming process of the shadow mask. If $B1>0.18$ mm, $B2>0.18$ mm and $B3>0.18$ mm, the brightness is lowered in the structures of the general shadow masks.

Preferably, the shadow mask 15 of the present invention satisfies the relations of 0.5 mm≦P1≦0.9 mm, 0.5 mm≦P2≦0.9 mm and 0.5 mm≦P3≦0.9 mm. If the vertical pitches P1, P2 and P3 are equal to or less than 200% of the thickness of the shadow mask, it is difficult to manufacture the shadow mask since etch is not easy. The vertical pitches P1, P2 and P3 that are too great allows the transmittance to be great, which is advantageous in the brightness characteristic but allows the area occupied by holes per unit area to be increased, resulting in the decrease in the strength of the shadow mask. In other words, if the vertical pitches are to great, the shadow mask will be torn during the forming process of the shadow mask. According to experiments, it is known that the transmittance per unit area is equal to or less than 20% so as to prevent the shadow mask from being torn. Therefore, it is desirable to allow the vertical pitch to have a relation of P≦0.9 mm so as to make the transmittance per unit area be equal to or less than 20%.

Considering that the thickness of the conventional slot type shadow mask 15 is in a range of 0.20–0.25 mm, the vertical pitch (P) is made to have a relation of P≧0.5 mm, which corresponds to 200% or more of the ratio of the vertical pitches P1, P2 and P3 to the thickness of the shadow mask for the enhancement of the etching property.

Thus, the vertical pitches P1, P2 and P3 preferably have the following relations: 0.5 mm≦P1≦0.9 mm, 0.5 mm≦P2≦0.9 mm and 0.5 mm≦P3≦0.9 mm.

Table 2 shows relations between holes and bridges of a shadow mask made of AK material used in 21 inches flat cathode ray tube according to an embodiment of the present invention.

TABLE 2

| | Embodiment | Comparative example | |
|---|---|---|---|
| | AK1 | AK2 | INVAR |
| B1 | 018 | 0.15 | 0.15 |
| P1 | | | |
| B2 | 0.22 | 0.18 | 0.18 |
| P2 | | | |
| B3 | 0.24 | 0.17 | 0.17 |
| P3 | | | |
| P1 | 0.65 | 0.75 | 0.75 |
| P2 | 0.64 | 0.73 | 0.73 |
| P3 | 0.64 | 0.73 | 0.73 |
| B1 | 0.12 | 0.12 | 0.12 |
| B2 | 0.14 | 0.13 | 0.132 |
| B3 | 0.15 | 0.12 | 0.12 |
| Doming | 42 μm | 70 μm | 25 μm |
| B/U | 50% | 48% | 48% |

In Table 2, B1 is a length of a bridge as a distance between holes 151 in a vertical direction at a center portion of the shadow mask 15, B2 is a length of a bridge as a distance between holes 151 in a vertical direction at four corner portions of the shadow mask 15, B3 is a length of a bridge as a distance between holes 151 at edge portions of the shadow mask in a direction of a long axis of the shadow mask 15, P1 is a vertical pitch of the holes 151 at the center portion of the shadow mask 15, P2 is a vertical pitch of the holes 151 at the four corner portions of the shadow mask 15, and P3 is a vertical pitch of the holes 151 at the edge portions of the shadow mask in a direction of a long axis of the shadow mask 15. And, the pitches P1, P2 and P3 and bridges B1, B2 and B3 are expressed in millimeter unit and B1/P1, B2/P2 and B3/P3 is dimensionless. The AK1 and AK2 are used for the discrimination of the embodiment according to the present invention and the comparative example. It can be seen that the doming and the bright uniformity are improved.

Referring to Table 2, the shadow mask made of AK material according to the present invention has a doming value that is different from the doming value of the conventional cathode ray tube having the shadow mask made of Invar, but is less than 70 μm that is the limit value of the color bleeding margin of the flat cathode ray tube, so that its use is possible.

The curvature radius of the shadow mask made of AK material according to the idea of the present invention will be described.

Figure 4:
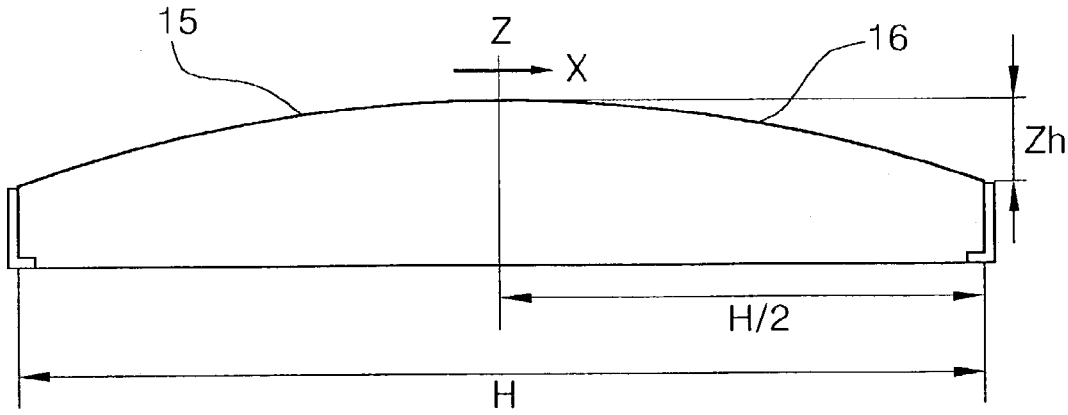
FIG. 4 is a side sectional view showing the mean curvature radius in the long axis direction at effective surface center of the shadow mask according to an embodiment of the present invention.

FIG. 4 is a side sectional view showing the mean curvature radius in long axis direction at effective surface center of the shadow mask according to an embodiment of the present invention. Referring to FIG. 4, the mean curvature radius in the direction of the long axis is defined as follows:

$$Rh = \frac{\left(\frac{H}{2}\right)^2 + Zh^2}{2 * Zh}$$

where Rh is a mean curvature radius in the direction of the long axis of the shadow mask, H is a distance between both ends in a direction of a long axis of an effective surface 16 of the shadow mask 15, and Zh is a recess amount in a direction of a tube axis at an end of the long axis of the effective surface 16 with respect to a center of the effective surface 16.

Table 3 shows the curvature radii Rh of the shadow masks 15 of the flat cathode ray tubes that are being mass-produce, including the 21 inches mask made of AK material that is the embodiment of the present invention.

TABLE 3

| | $\frac{Rh}{\left(\frac{H}{2}\right)}$ |
|---|---|
| 21" AK | 6.68 |
| 21" INVAR | 8.90 |
| 25" INVAR | 9.26 |
| 29" INVAR | 9.98 |
| 28" INVAR | 8.29 |
| 32" INVAR | 8.61 |

Referring to table 3, it is well known that the curvature radius (Rh) of the conventional shadow mask 3 is designed to be great as a whole. To this end, the conventional shadow mask 3 is weak in the maintenance strength of the curved surface, so that it is easily deformed by an impact in manufacturing process.

On the other hand, Table 4 shows the strengths of the shadow masks 3 with respect to curvature radii (Rh) in the direction of a long axis. The data correspond to 21" shadow masks made of AK material and to relative values of weights at buckling point of the five shadow masks (a), (b), (c), (d) and (e). The data of the table 4 were obtained with a critical value of 60 that is converted into a reference value of 100 at which the shadow mask is easily deformed during the manufacturing process of the color cathode ray tubes. The strength data of the shadow masks 3 are computed by CAE (Computer Aided Engineering) simulation.

TABLE 4

| | $\frac{Rh}{\left(\frac{H}{2}\right)}$ | Weight at buckling point |
|---|---|---|
| (a) | 5.0 | 253 |
| (b) | 6.0 | 198 |
| (c) | 7.0 | 151 |
| (d) | 8.0 | 102 |
| (e) | 9.0 | 53 |

In table 4, the weight means an endurable maximum weight. The greater the weight is, the greater the strength is. The bucking point is the time when the shadow mask starts to be deformed while the weight is loaded to the entire surface of the shadow mask.

Figure 5:
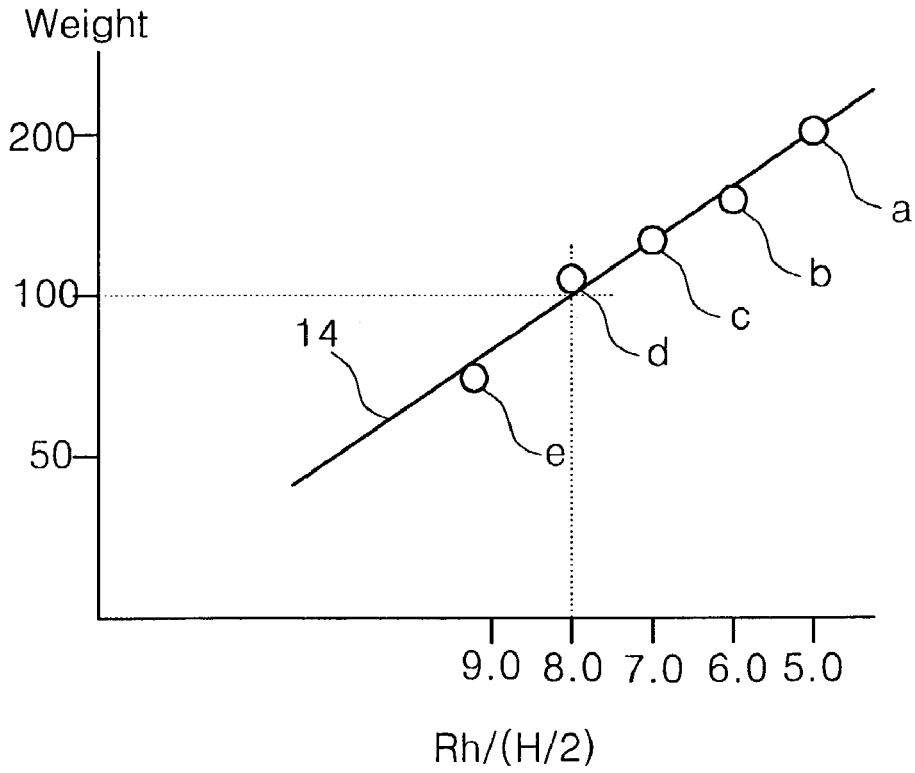
FIG. 5 is an approximation graph of weight at the buckling point of the shadow mask illustrated in table 4.

FIG. 5 shows an approximation graph of weights at the buckling point of the shadow mask illustrated in Table 4. Referring to FIG. 5, the value of the condition $$\frac{Rh}{\left(\frac{H}{2}\right)}$$

corresponding to the reference value of 100 is obtained based on the approximation line 14 and is 8.0. Based on the above relation, the relation of $$\frac{Rh}{\left(\frac{H}{2}\right)} < 8.0$$

is derived as the reference of the equation $$\frac{Rh}{\left(\frac{H}{2}\right)}$$

to obtain good maintenance strength of the curved surface. Explaining the above relation again, in order to properly maintain the maintenance strength of the curved surface that is significant in flat cathode ray tubes, it is requested that the value of condition $$\frac{Rh}{\left(\frac{H}{2}\right)}$$

be less than 0.8, which prevents the deformation of the shadow mask 15 that may occur while manufacturing and carrying flat cathode ray tubes.

On the other hand, when a shadow mask made of AK is employed in a flat cathode ray tube, the smaller curvature radius Rh of the shadow mask is advantageous to the minimizing of the doming effect. Meanwhile, in order to keep a predetermined resolution, the curvature radius of the inner surface of the panel 1 should be also small. In this case, the outer surface of the panel 1 is substantially flat and the inner surface of the panel 1 has the predetermined curvature radius. Such a panel 1 is required to configure a flat cathode ray tube to allow TV watchers to see flat images.

However, if the ratio of the thickness Td of peripheral portion of the panel 1 to the thickness Tc of a central potion of the panel 1 exceeds some threshold value, the transmittance of the peripheral portions of the panel 1 is reduced, so that the brightness and the visibility are reduced.

Table 5 shows the ratio of the thickness Td of the peripheral portion of the panel 1 to the thickness Tc of the central portion of the panel 1 on condition that the curvature radius (Rh) in a direction of a long axis of the shadow mask is changed and the ratio of the transmittance of peripheral portions to the transmittance of central portion is 40%.

TABLE 5

| | $\frac{Rh}{\left(\frac{H}{2}\right)}$ | $\frac{\text{Thickness of peripheral portion}}{\text{Thickness of central portion}}\left(\frac{Td}{Tc}\right)$ | Doming amount |
|---|---|---|---|
| (a) | 5.0 | 2.6 | 43 μm |
| (b) | 6.0 | 2.4 | 51 μm |
| (c) | 7.0 | 2.2 | 60 μm |
| (d) | 8.0 | 2.0 | 68 μm |
| (e) | 9.0 | 1.8 | 77 μm |

Figure 6:
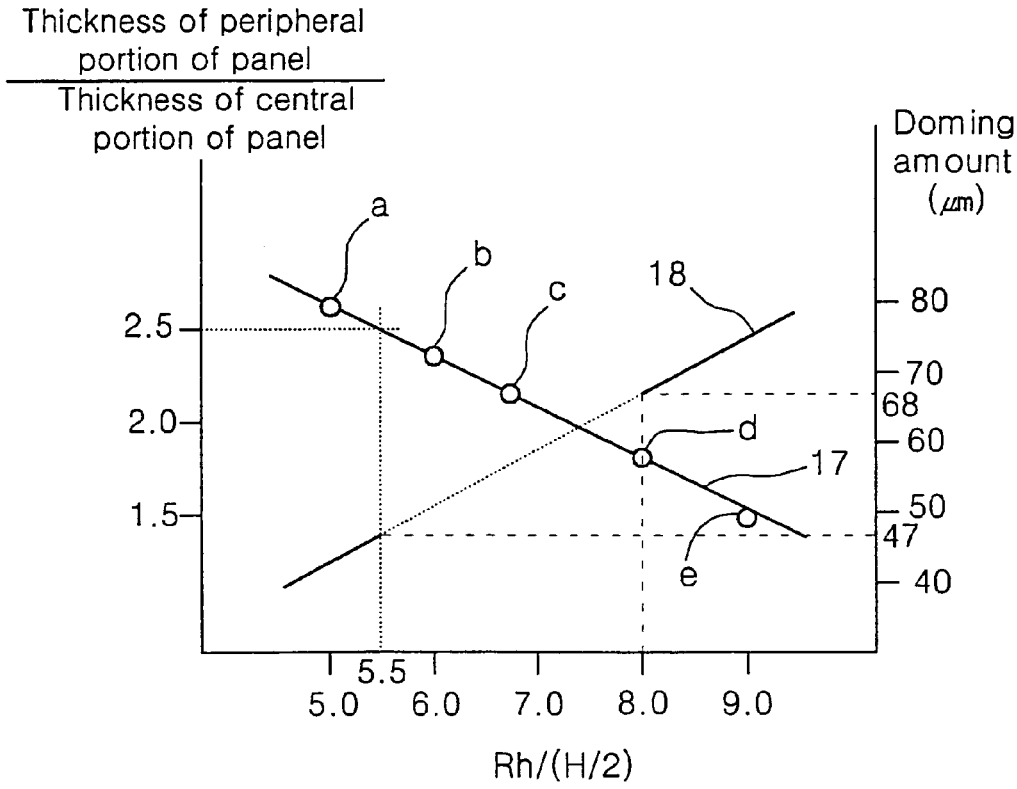
FIG. 6 is an approximation graph of ratio of thickness of peripheral portion to thickness of center portion of the panel illustrated in table 5.

FIG. 6 is an approximation graph of the data illustrated in the Table 5. Referring to FIG. 6, obtained is an approximation line 17 of ratio of thickness of peripheral portion (corner portions) of the panel to thickness of central portion of the panel corresponding to five kinds of shadow masks represented in table 5.

On the other hand, the greater thickness ratio of the panel increases the weight of the panel, and the increased weight of the panel causes a problem in the productivity of the panel, resulting in the rise of the production costs, the lowering in the brightness, and a difficulty in the securing of the visibility. To this end, it is requested that the thickness ratio of the panel be less than 2.5 at most.

A value of the condition $$\frac{Rh}{\left(\frac{H}{2}\right)}$$

corresponding to the reference value of 2.5 for the thickness ratio is obtained with reference to the approximation graph 17 of FIG. 6, and is 5.5.

In other words, in order to reduce the doming effect followed by the application of the shadow mask made of AK material, it is requested that the curvature radius be designed to be small but the value of the condition $$\frac{Rh}{\left(\frac{H}{2}\right)}$$

should be designed to be greater than 5.5 owing to the lowering of the transmittance of the peripheral portion of the panel and the visibility problem as the ratio of the thickness of the peripheral portion of the panel to the thickness of the center portion of the panel increases.

In the meantime, the ratio of the thickness of the peripheral portion of the panel to the thickness of the center portion of the panel increases such that the outer surface of the panel is approximately flat in order to realize a flat picture and the inner surface of the panel has a predetermined curvature.

Tables 5 and 6 also show a doming graph 18 as the doming amount caused from thermal expansion of the shadow mask according to the value of $$\frac{Rh}{\left(\frac{H}{2}\right)}.$$

As will be seen in FIG. 6, the doming amount is ranged from 47 $\mu$m to 68 $\mu$m in the range $$5.5 < \frac{Rh}{\left(\frac{H}{2}\right)} < 8.0.$$

When the shadow mask made of AK material is used in the 21" color cathode ray tube of the embodiment of the present invention and the doming amount is 70 $\mu$m or less, there is no color purity problem. In addition, when the shadow mask made of AK material is used in another sized color cathode ray tube according to the embodiment of the present invention and the doming amount is 70 $\mu$m or less, there is no color purity problem.

Table 6 represents the mean curvature radii in the directions of a long axis, a short axis and a diagonal axis of the 21" shadow mask of the embodiment of the present invention made of AK material and the shadow masks of the conventional flat cathode ray tube.

TABLE 6

| | Rh (Mean curvature radius, X-direction) | Rv (Mean curvature radius, Y-direction) | Rd (Mean curvature radius, D-direction) |
|---|---|---|---|
| 21" AK | 1249 | 1511 | 1545 |
| 25" INVAR | 2009 | 1807 | 1637 |
| 29" INVAR | 2488 | 1855 | 2289 |
| 28" INVAR | 2189 | 2141 | 1910 |
| 32" INVAR | 2646 | 2311 | 2399 |

Referring to Table 6, like the definition of the mean curvature radius Rh in the direction of the long axis of the shadow mask, the mean curvature radius Rh in the direction of the short axis of the shadow mask is defined as:

$$Rv = \frac{\left(\frac{V}{2}\right)^2 + Zv^2}{2 * Zv}$$

,where Rv is mean curvature radius, V is a distance between both ends in the direction of the short axis of the shadow mask, and Zv is a recess amount in the direction of a tube axis at an end of the short axis of the effective surface 13 with respect to the center of the effective surface 13.

The mean curvature radius Rd in the direction of a diagonal axis of the shadow mask satisfies the following condition:

$$Rd = \frac{\left(\frac{D}{2}\right)^2 + Zd^2}{2 * Zd}$$

,where Rd is mean curvature radius, D is a distance between both ends in the direction of the diagonal axis of the shadow mask, and Zd is a recess amount in the direction of the tube axis at an end of the diagonal axis of the effective surface 13 with respect to the center of the effective surface 13.

As a whole, the mean curvature radius in the direction of the short axis in the conventional shadow mask is designed to be smaller than the mean curvature radius in the direction of the long axis in the conventional shadow mask. However, in the cathode ray tube whose fluorescent surface is in a stripe shape, the factor influencing the color purity is X-direction. In order to reduce the doming effect caused by applying a shadow mask made of AK material, the mean curvature radius in the direction of the long axis of the shadow mask should be designed to be smaller than the mean curvature radii in the directions of the short axis and the diagonal axis of the shadow mask. In other words, the expressions Rh<Rv and Rh<Rd should be satisfied.

On the other hand, there may be provided a method for reducing the doming effect caused by applying the shadow mask made of AK to a flat cathode ray tube. The method designs the shadow mask 15 thicker. If the shadow mask 15 is thick, thermal expansion can be compensated by elevating the thermal capacity of the shadow mask 15 even though the shadow mask 15 is expanded by heat due to collision of electron beams. However, if the shadow mask 15 is too thick, etching and formability are problematic and the weight of the shadow mask becomes too heavy. Therefore, the weight of the shadow mask 15 of the present invention is limited to a range of 0.20–0.25 mm.

With the same principle as the method for elevating the thermal capacity by making the shadow mask thicker, the transmittance of the shadow mask is made smaller at the same thickness, e.g., the interval between the holes formed in the shadow mask 15 is made larger to thereby obtain the same effect.

Figure 7:
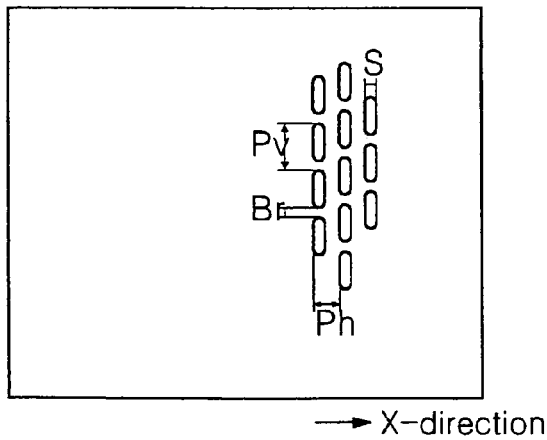
FIG. 7 illustrates variation in size of a bridge that is a gap of through holes for electron beams in the shadow mask according to an embodiment of the present invention.

Referring to FIG. 7, in the shadow mask according to the present invention, the bridge that is the interval between the holes which electron beams pass through is increased as it goes to the direction of a long axis (X-direction). This makes the thermal capacity of the shadow mask increase as it travels in the X-direction. As a result, the doming effect influencing the color purity in a stripe-shaped flat cathode ray tube can be effectively reduced.

The length of the bridge of the shadow mask 15 is preferably limited to a range of 0.12–0.18 mm. This is because the bridge that is too short in length is cut during the forming process of the shadow mask and thus the shadow mask 15 is broken. A further reason why the length of the bridge of the shadow mask 15 should be less than 0.18 mm is that the value of 0.18 is a critical value (20% of the vertical pitch (Pv) ranged from 0.6 mm to 0.9 mm in the conventional shadow mask 3) not to cause the lowering problem in the brightness. If the length of the bridge is 0.18 mm or more, the area through which electron beams pass is decreased, so that the brightness is lowered.

If the shadow mask of the present invention is used for a cathode ray tube, the doming phenomena at the end of the portions having holes in the direction of a long axis and the brightness lowering at the end of the portions having holes in the direction of a diagonal axis can be avoided.

The present invention can enhance the curved surface sustain strength and reduce the thickness difference between the center portion and the peripheral portions, thereby securing the visibility and effectively improving the doming influencing the color purity.

The present invention allows the use of a shadow mask made of AK material that costs one third price of the shadow mask of INVAR material so that the production price can be lowered.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A color cathode ray tube comprising:

a panel having a fluorescent surface therein;

a funnel coupled sealingly with the panel;

electron guns installed in the funnel, for projecting electron beams;

a deflection yoke for deflecting the electron beams; and a shadow mask for selecting colors, wherein the shadow mask satisfies the following condition:

$$\frac{B1}{P1} \leq \frac{B2}{P2} < \frac{B3}{P3};$$

where B1 is a length of a bridge as a distance between holes in a vertical direction at a center portion of the shadow mask;

B2 is a length of a bridge as a distance between holes in a vertical direction at a corner portion of the shadow mask;

B3 is a length of a bridge as a distance between holes at edge portions of the shadow mask in a direction of a long axis thereof;

P1 is a vertical pitch of the holes at the center portion of the shadow mask;

P2 is a vertical pitch of the holes at a corner portion of the shadow mask; and

P3 is a vertical pitch of the holes at the edge portions of the shadow mask in a direction of a long axis thereof.

2. The color cathode ray tube according to claim 1, wherein the shadow mask is made of an Aluminum Killed material.

3. The color cathode ray tube according to claim 1, wherein an outer surface of the panel is substantially flat and an inner surface has a predetermined curvature.

4. The color cathode ray tube according to claim 1, wherein the shadow mask satisfies the following conditions:

$Rh<Rv$, and $Rh<Rd$, where Rh is a mean curvature radius in the direction of the long axis of the shadow mask, Rv is a mean curvature radius in a direction of a short axis thereof, and Rd is a mean curvature radius in a diagonal direction thereof.

5. The color cathode ray tube according to claim 1, wherein the shadow mask satisfies the following condition:

$0.5\ mm \leqq P1 \leqq 0.9\ mm$, $0.5\ mm \leqq P2 \leqq 0.9\ mm$, and $0.5\ mm \leqq P3 \leqq 0.9\ mm$.

6. A color cathode ray tube comprising:

a panel having a fluorescent surface therein;

a funnel coupled sealingly with the panel;

electron guns installed in the funnel, for projecting electron beams;

a deflection yoke for deflecting the electron beams; and a shadow mask for selecting colors, wherein the shadow mask satisfies the following condition:

$$\frac{B2}{P2} < \frac{B3}{P3} \quad \text{and} \quad B1 \leq B2 \leq B3;$$

where B1 is a length of a bridge as a distance between holes in a vertical direction at a center portion of the shadow mask;

B2 is a length of a bridge as a distance between holes in a vertical direction at a corner portion of the shadow mask;

B3 is a length of a bridge as a distance between holes at edge portions of the shadow mask in a direction of a long axis thereof;

P2 is a vertical pitch of the holes at a corner portion of the shadow mask; and

P3 is a vertical pitch of the holes at the edge portions of the shadow mask in a direction of a long axis thereof.

7. The color cathode ray tube according to claim 6, wherein the shadow mask satisfies the following condition:

$0.10\ mm \leqq B1 \leqq 0.18\ mm$, $0.10\ mm \leqq B2 \leqq 0.18\ mm$, and $0.10\ mm \leqq B3 \leqq 0.18\ mm$.

8. The color cathode ray tube according to claim 6, wherein the shadow mask is made of an Aluminum Killed material.

9. The color cathode ray tube according to claim 6, wherein the shadow mask satisfies the following conditions:

$Rh<Rv$, and $Rh<Rd$, where Rh is a mean curvature radius in the direction of the long axis of the shadow mask, Rv is a mean curvature radius in a direction of a short axis thereof, and Rd is a mean curvature radius in a diagonal direction thereof.

10. The color cathode ray tube according to claim 6, wherein the shadow mask satisfies the following condition:

$0.5\ mm \leqq P1 \leqq 0.9\ mm$, $0.5\ mm \leqq P2 \leqq 0.9\ mm$, and $0.5\ mm \leqq P3 \leqq 0.9\ mm$, where P1 is a vertical pitch of the holes at the center portion of the shadow mask.

11. A color cathode ray tube comprising:

a panel having a fluorescent surface therein;

a funnel coupled sealingly with the panel;

electron guns installed in the funnel, for projecting electron beams;

a deflection yoke for deflecting the electron beams; and a shadow mask for selecting colors, wherein the shadow mask satisfies the following condition:

$$\frac{B2}{P2} < \frac{B3}{P3} \quad \text{and} \quad P3 \leq P2 \leq P1;$$

where B2 is a length of a bridge as a distance between holes in a vertical direction at a corner portion of the shadow mask;

B3 is a length of a bridge as a distance between holes at edge portions of the shadow mask in a direction of a long axis thereof;

P1 is a vertical pitch of the holes at the center portion of the shadow mask;

P2 is a vertical pitch of the holes at a corner portion of the shadow mask; and

P3 is a vertical pitch of the holes at the edge portions of the shadow mask in a direction of a long axis thereof.

12. The color cathode ray tube according to claim 11, wherein the shadow mask is made of an Aluminum Killed material.

13. The color cathode ray tube according to claim 11, wherein the shadow mask satisfies the following conditions:

$$Rh<Rv, \text{ and}$$

$$Rh<Rd,$$

where Rh is a mean curvature radius in the direction of the long axis of the shadow mask, Rv is a mean curvature radius in a direction of a short axis thereof, and Rd is a mean curvature radius in a diagonal direction thereof.

14. The color cathode ray tube according to claim 11, wherein the shadow mask satisfies the following condition:

$$0.5 \text{ mm} \leqq P1 \leqq 0.9 \text{ mm},$$

$$0.5 \text{ mm} \leqq P2 \leqq 0.9 \text{ mm, and}$$

$$0.5 \text{ mm} \leqq P3 \leqq 0.9 \text{ mm.}$$

15. A color cathode ray tube comprising:

a panel having a fluorescent surface therein;

a funnel coupled sealingly with the panel;

electron guns installed in the funnel, for projecting electron beams;

a deflection yoke for deflecting the electron beams; and a shadow mask for selecting colors, wherein the shadow mask satisfies the following condition:

$$\frac{B2}{P2} < \frac{B3}{P3} \quad \text{and} \quad 0.15 \leq \frac{B2}{P2} \leq 0.36;$$

where B2 is a length of a bridge as a distance between holes in a vertical direction at a corner portion of the shadow mask;

B3 is a length of a bridge as a distance between holes at edge portions of the shadow mask in a direction of a long axis thereof;

P2 is a vertical pitch of the holes at a corner portion of the shadow mask; and

P3 is a vertical pitch of the holes at the edge portions of the shadow mask in a direction of a long axis thereof.

16. The color cathode ray tube according to claim 15, wherein the shadow mask is made of an Aluminum Killed material.

17. The color cathode ray tube according to claim 15, wherein the shadow mask satisfies the following conditions:

$$Rh<Rv, \text{ and}$$

$$Rh<Rd,$$

where Rh is a mean curvature radius in the direction of the long axis of the shadow mask, Rv is a mean curvature radius in a direction of a short axis thereof, and Rd is a mean curvature radius in a diagonal direction thereof.

18. The color cathode ray tube according to claim 15, wherein the shadow mask satisfies the following condition:

$$0.5 \text{ mm} \leqq P1 \leqq 0.9 \text{ mm},$$

$$0.5 \text{ mm} \leqq P2 \leqq 0.9 \text{ mm, and}$$

$$0.5 \text{ mm} \leqq P3 \leqq 0.9 \text{ mm},$$

where P1 is a vertical pitch of the holes at the center portion of the shadow mask.

19. A color cathode ray tube comprising:

a panel having a fluorescent surface therein;

a funnel coupled sealingly with the panel;

electron guns installed in the funnel, for projecting electron beams;

a deflection yoke for deflecting the electron beams; and a shadow mask for selecting colors, wherein the shadow mask satisfies the following condition:

$$\frac{B2}{P2} < \frac{B3}{P3} \quad \text{and} \quad 0.15 \leq \frac{B2}{P2} \leq 0.36;$$

where B2 is a length of a bridge as a distance between holes in a vertical direction at a corner portion of the shadow mask;

B3 is a length of a bridge as a distance between holes at edge portions of the shadow mask in a direction of a long axis thereof;

P2 is a vertical pitch of the holes at a corner portion of the shadow mask; and

P3 is a vertical pitch of the holes at the edge portions of the shadow mask in a direction of a long axis thereof.

20. The color cathode ray tube according to claim 19, wherein the shadow mask is made of an Aluminum Killed material.

21. The color cathode ray tube according to claim 19, wherein the shadow mask satisfies the following conditions:

$$Rh<Rv, \text{ and}$$

$$Rh<Rd,$$

where Rh is a mean curvature radius in the direction of the long axis of the shadow mask, Rv is a mean curvature radius in a direction of a short axis thereof, and Rd is a mean curvature radius in a diagonal direction thereof.

22. The color cathode ray tube according to claim 19, wherein the shadow mask satisfies the following condition:

$$0.5\ \text{mm} \leqq P1 \leqq 0.9\ \text{mm},$$

$$0.5\ \text{mm} \leqq P2 \leqq 0.9\ \text{mm}, \text{ and}$$

$$0.5\ \text{mm} \leqq P3 \leqq 0.9\ \text{mm},$$

where P1 is a vertical pitch of the holes at the center portion of the shadow mask.

* * * * *